US012331593B1

(12) United States Patent
Zhu et al.

(10) Patent No.: US 12,331,593 B1
(45) Date of Patent: Jun. 17, 2025

(54) COMBINED DRILL BIT BASED ON ELECTRO-PULSE-DRILLING TECHNOLOGY

(71) Applicant: Southwest Petroleum University, Chengdu (CN)

(72) Inventors: Xiaohua Zhu, Chengdu (CN); Weiji Liu, Chengdu (CN); Hai Hu, Chengdu (CN)

(73) Assignee: Southwest Petroleum University, Chengdu (CN)

( * ) Notice: Subject to any disclaimer, the term of this patent is extended or adjusted under 35 U.S.C. 154(b) by 0 days.

(21) Appl. No.: 18/638,693

(22) Filed: Apr. 18, 2024

(30) Foreign Application Priority Data

Dec. 13, 2023 (CN) ..... 202311704254.7

(51) Int. Cl.
*E21B 10/567* (2006.01)
*E21B 7/15* (2006.01)

(52) U.S. Cl.
CPC ..... *E21B 10/567* (2013.01); *E21B 7/15* (2013.01)

(58) Field of Classification Search
CPC ..... E21B 10/00; E21B 7/14; E21B 7/15
See application file for complete search history.

(56) References Cited

FOREIGN PATENT DOCUMENTS

| | | | | |
|---|---|---|---|---|
| CN | 109577864 A | * | 4/2019 | ..... E21B 10/00 |
| CN | 112593849 A | * | 4/2021 | ..... E21B 10/43 |
| CN | 113565449 A | * | 10/2021 | |

* cited by examiner

*Primary Examiner* — Caroline N Butcher

(57) ABSTRACT

A combined drill bit based on the electro-pulse-drilling technology includes a PDC bit, a ground electrode, a high-voltage electrode, a high-voltage electrode spring, an electrode drill bit spring, electrode screws, an insulating rod, an insulating spline sleeve, a high-voltage cable connector, an insulating limit cover, a lower bearing, an upper bearing, an end cover, and a conical connecting component. The combined drill bit combines the PDC bit and the electro-pulse-drilling technology, can not only overcome shortcomings of poor wall quality and difficulty in controlling borehole trajectory in process of electro-pulse drilling, but also improve the efficiency of deep-well drilling.

10 Claims, 11 Drawing Sheets

A–A

COMBINED DRILL BIT BASED ON ELECTRO-PULSE-DRILLING TECHNOLOGY

TECHNICAL FIELD

The disclosure relates to the field of drilling technology, and more particularly to a combined drill bit based on the electro-pulse-drilling technology.

BACKGROUND

Rapid development of the world economy leads to an increasing demand for energy in various countries. To meet the increasing demand for energy, obtaining oil, natural gas and geothermal energy from deep strata plays an increasingly important role in energy supply, and naturally, a proportion of exploration and development of deep wells and ultra-deep wells is also increasing. Generally, rocks in deep strata have characteristics such as high abrasiveness, high hardness, and poor drill-ability, and these characteristics are enhanced with the increase of well depth. Conventional drilling techniques usually rely on the scraping, shearing and squeezing of the bit on rock to cause disintegration. Hence, the bit often suffers from serious wear and tooth collapse, which greatly reduces the drilling efficiency. Therefore, with deepening development of natural resources and increasing complexity of geological conditions, it is urgent to study new efficient rock-breaking technology and design the corresponding drilling tools.

Exploring the efficient drilling technology is of great significance to improve the drilling speed, reduce the drilling cost and shorten the drilling cycle. With progress of science and technology, many scholars and researchers proposed and researched high-efficiency drilling technologies, such as water jet, pulse jet, cavitation jet, ultrasonic drilling, laser drilling, and electro-pulse-drilling technology, etc. Among them, the electro-pulse-drilling technology has the unique advantages such as high rock-breaking efficiency, controllable energy, and no pollution, etc. Hence, the electro-pulse-drilling technology is widely used in fields of rock mining and mineral decomposition. However, most of current research on the electro-pulse-drilling technology only focus on vertical drilling. Due to its fragile structure, the electrode bit can only withstand low bit weight, making directional drilling much tough. On the other hand, due to the random discharge of the electrode bit, the walls of the borehole formed in the rock are usually rough and always filled with random pits or grooves. Above two problems limit a wider industrial application of the electro-pulse-drilling technology.

SUMMARY

Based on above engineering background, the disclosure combines the electro-pulse-drilling technology with the conventional rotary mechanical drilling technology, aiming at realizing directional drilling on the basis of high rock-breaking efficiency of the electro-pulse-drilling technology, and ensuring the quality of well walls.

To achieve above purposes, the disclosure provides a combined drill bit based on the electro-pulse-drilling technology. The combined drill bit based on the electro-pulse-drilling technology includes a ground electrode, an insulating rod, a high-voltage electrode spring (i.e., electrode spring), a high-voltage electrode (i.e., connecting electrode), an insulating spline sleeve, an upper bearing, a conical connecting component, a polycrystalline diamond compact (PDC) bit, electrode screws, an electrode drill bit spring, a lower bearing, a high-voltage cable connector (i.e., cable connector), an insulating limit cover, and an end cover. The ground electrode is a cylindrical structure, a lower end of the ground electrode is provided with a centrally symmetrical petal-shaped structure, and a circumferential surface of an upper part of the ground electrode defines screw holes and a welding hole configured to weld an earth cable. An upper part of the insulating rod is provided with a spline, an upper end surface of the insulating rod defines drilling fluid flow channels and a cable hole configured to install the earth cable, a center axis of the insulating rod defines an electrode-installed hole, a middle-lower part of the insulating rod defines electrode screw holes, and a lower part of the insulating rod is provided with a conical structure (i.e., a surface of the lower part of the insulating rod is a conical surface). The high-voltage electrode is a rod-shaped structure, a lower end of the high-voltage electrode is provided with a conical structure (i.e., a surface of the lower end of the high-voltage electrode is a conical surface), and a middle-lower part of the high-voltage electrode is provided with a spring step installed with the high-voltage electrode spring, and an upper part of the high-voltage electrode is provided with a connector step and a threaded structure which are connected the high-voltage cable connector. The insulating spline sleeve is a hollow structure, an upper part of the insulating spline sleeve is provided with an outer step and screw threads which are matched with the insulating limit cover, an inner part of the insulating spline sleeve is provided with a spline structure matched with the insulating rod, and a lower part of the insulating spline sleeve is provided with a lower bearing step matched with the lower bearing. The high-voltage cable connector is a cylindrical structure, a center of an upper end surface of the high-voltage cable connector defines a cable groove configured to weld high-voltage cables (i.e., cables), and a center axis of a lower part of the high-voltage cable connector defines a threaded hole matched with the high-voltage electrode. A center of the insulating limit cover defines a limit cover through-hole, an inner part of the insulating limit cover is provided with a limit cover inner step and screw threads which are matched with the insulating spline sleeve, and an outer circumferential surface of the insulating limit cover is provided with an upper bearing step matched with the upper bearing. A center axis of the end cover defines a flow channel, an outer circumferential surface of the end cover is provided with screw threads matched with the PDC bit, and a lower part of the end cover defines an annular groove installed with the insulating limit cover, the lower part of the end cover is provided with a bearing step fixed with the upper bearing, and the lower part of the end cover is further provided with an inner step, and an upper surface of the end cover defines square grooves for easy installation. The PDC bit is a hollow structure, the PDC bit is provided with an internal bearing step installed with the lower bearing, an inner cylindrical surface of a top of the PDC bit is provided with screw threads matched with the end cover, and the PDC bit defines drilling fluid holes. The conical connecting component is a hollow structure and is fixedly connected with the PDC bit by welding, and an outer surface of the conical connecting component is provided with screw threads.

Furthermore, the high-voltage electrode spring and the electrode drill bit spring are both compression springs with low rigidity and high elasticity.

Furthermore, the upper bearing and the lower bearing are identical angular contact ball bearings and are installed face-to-face.

Furthermore, the ground electrode is in a clearance fit with the PDC bit, the high-voltage electrode is in a clearance fit with the insulating rod, the insulating spline sleeve is in a clearance fit with the PDC bit, and the high-voltage cable connector is in a clearance fit with the insulating rod.

Furthermore, the insulating spline sleeve is in an interference fit with the lower bearing, the lower bearing is in an interference fit with the PDC bit, the insulating limit cover is in an interference fit with the upper bearing, and the upper bearing is in an interference fit with the PDC bit.

Furthermore, the number of the drilling fluid holes are same as the number of blades of the PDC bit.

Furthermore, the number of the drilling fluid flow channels of the insulating rod is 4 to 6, and the number of the electrode screw holes of the insulating rod is 3 to 5.

Furthermore, a drilling fluid path I of the combined drill bit is defined by an inner cavity of the conical connecting component, the flow channel of the end cover, the limit cover through-hole of the insulating limit cover, an inner cavity of the insulating spline sleeve, and the drilling fluid flow channels of the insulating rod; a drilling fluid path II of the combined drill bit is defined by the inner cavity of the conical connecting component and the drilling fluid holes of the PDC bit; and a drilling fluid circulation path is defined by the drilling fluid path I, the drilling fluid path II and blade notches.

Furthermore, the insulating rod, the insulating spline sleeve and the insulating limit cover are all made of insulating materials.

Furthermore, the high-voltage electrode spring is fixedly connected with the high-voltage electrode by welding, and the electrode drill bit spring is fixedly connected with the ground electrode by welding.

Compared to drill bits in related art, the disclosure has following advantages.

1. The electro-pulse-drilling technology is combined with the rotary mechanical rock-breaking technology, realizing the directional drilling on the basis of the high efficiency rock-breaking of the electro-pulse-drilling technology, and at the same time ensuring the quality of the well walls.
2. Under action of the spline structure and a pair of the angular contact ball bearings, the ground electrode and the high-voltage electrode can rotate relative to the PDC bit, thereby to remain relative stillness during the drilling process, reduce wear of electrodes and prolong overall life span of the combined drill bit.
3. Under action of the high-voltage electrode spring, the electrode drill bit spring and the spline structure, the ground electrode and high-voltage electrode can have axial displacement, ensuring that the electrodes can be continuously in close contact with rock surfaces at the bottom of well, and improving the energy utilization rate.
4. The high-voltage electrode spring and the electrode drill bit spring can absorb impact generated during process of the electro-pulse rock-breaking, thus effectively extending operating life of the combined drill bit.

DESCRIPTION OF REFERENCE NUMERALS

Figure 1A:
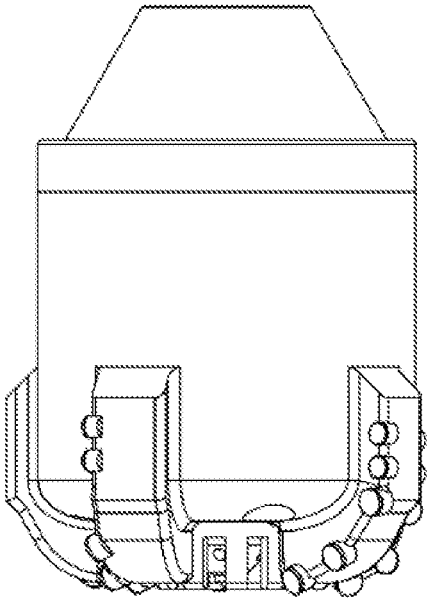
FIG. 1A to FIG. 1C illustrate schematic structural diagrams of a combined drill bit based on the electro-pulse-drilling technology.
Figure 1B:
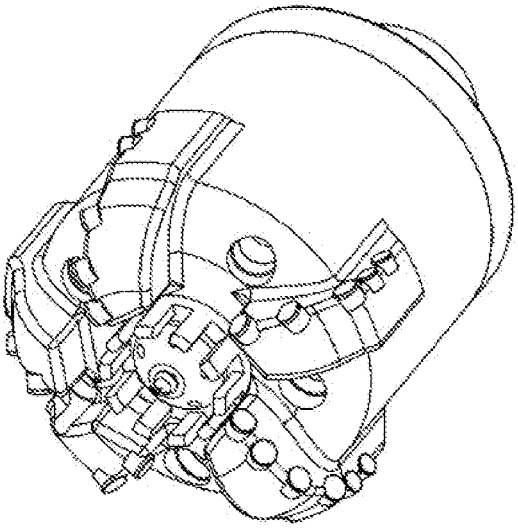
Figure 1C:
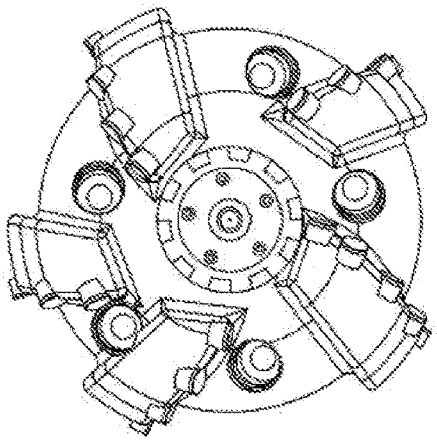
Figure 2:
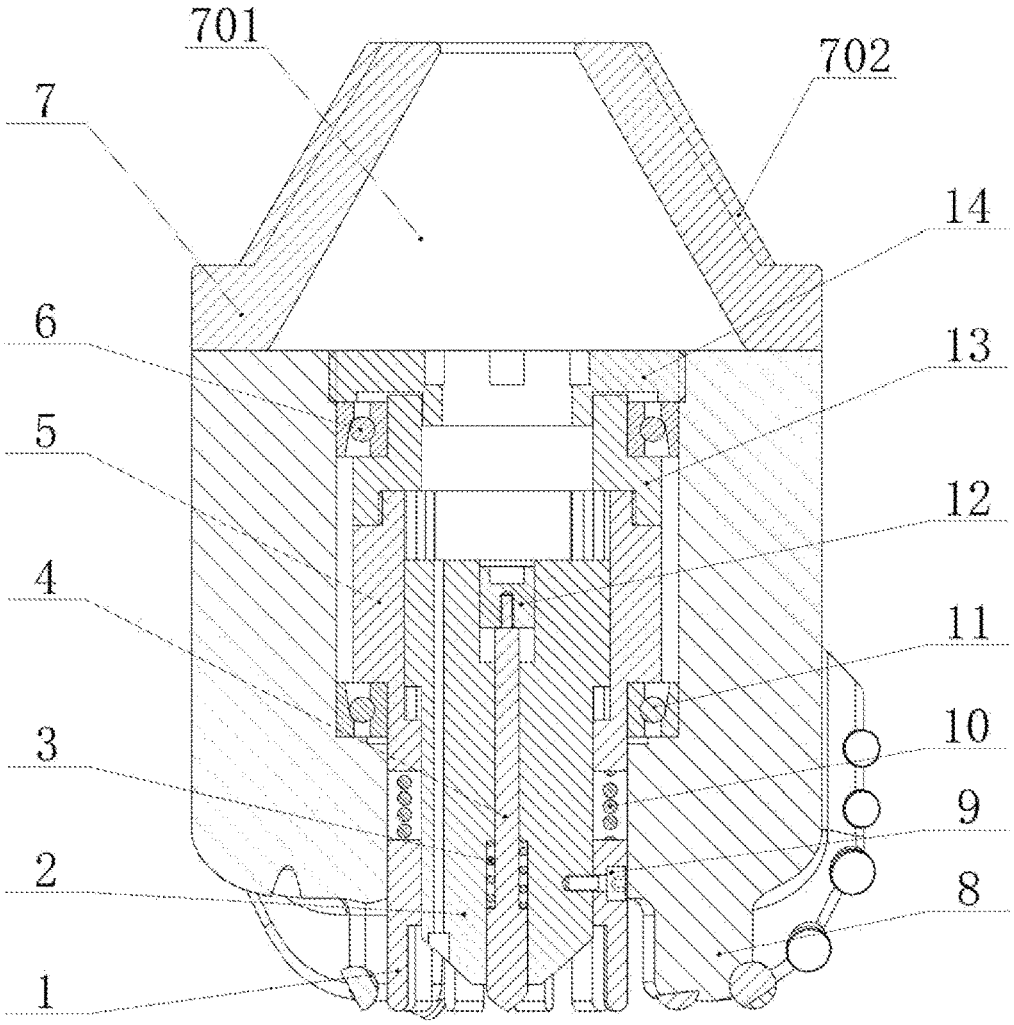
FIG. 2 illustrates a schematic diagram of an overall structure of the combined drill bit of the disclosure.
Figure 3A:
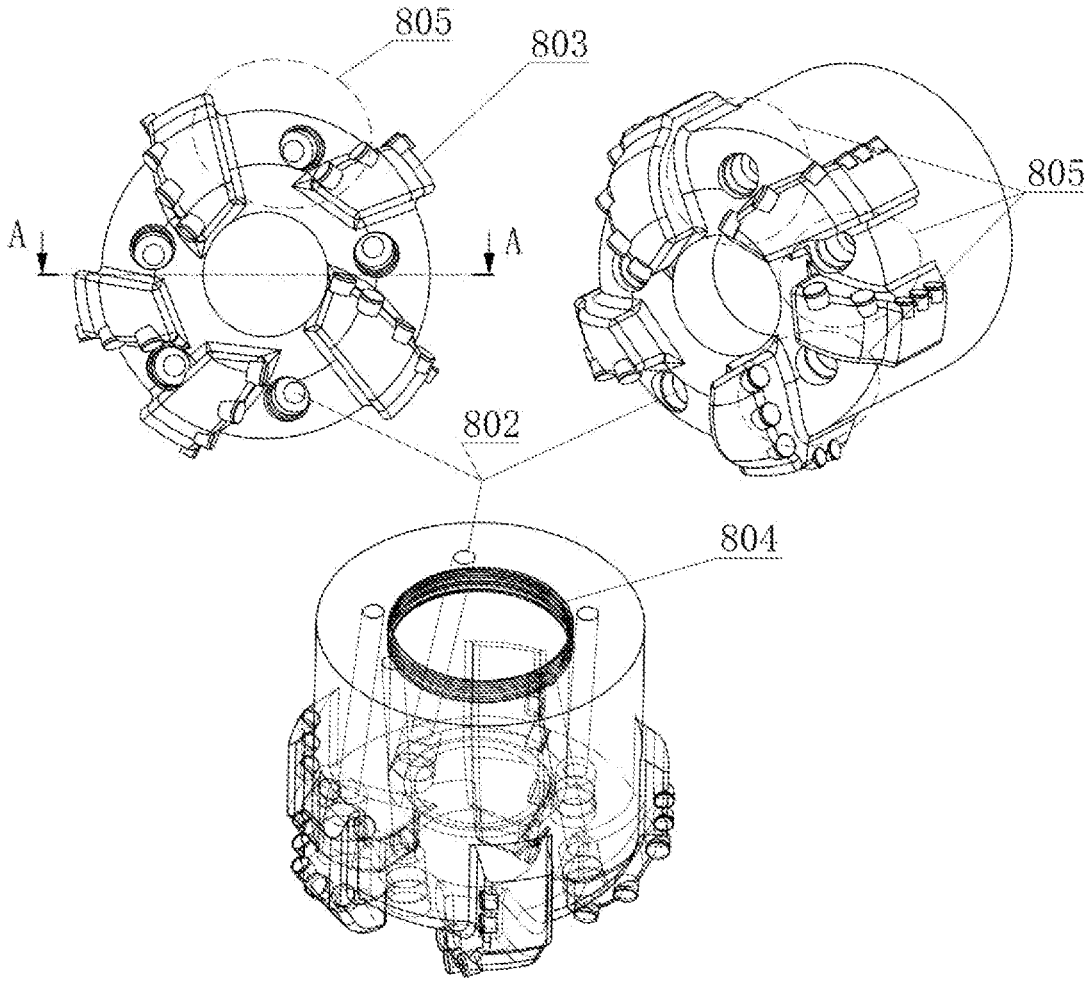
FIG. 3A and FIG. 3B illustrate schematic structural diagrams of a PDC bit.
Figure 3B:
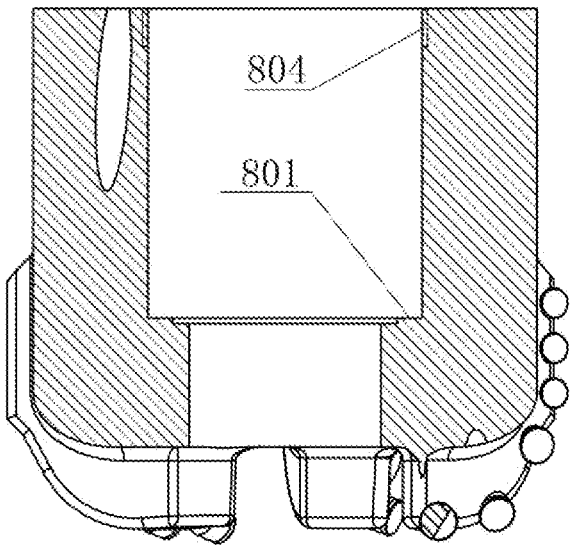
Figure 4A:
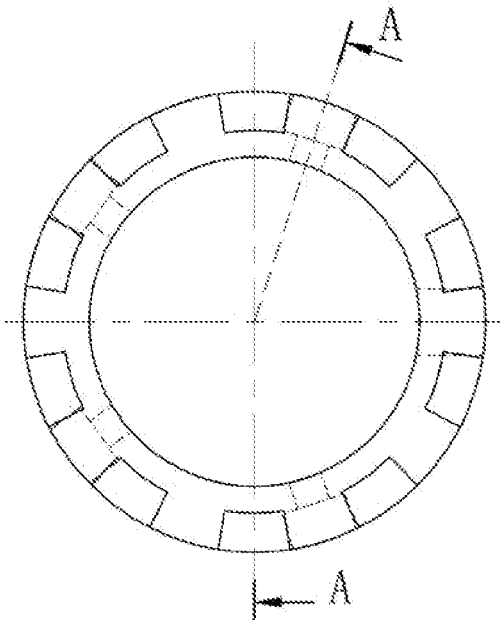
FIG. 4A to FIG. 4D illustrate schematic structural diagrams of a ground electrode.
Figure 4B:
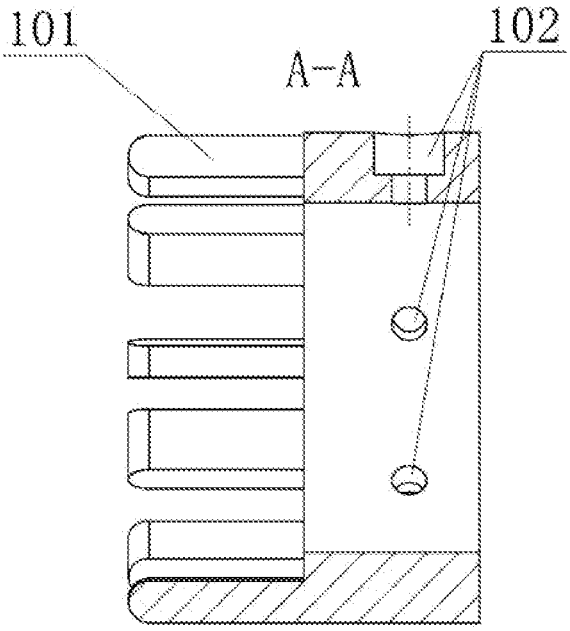
Figure 4C:
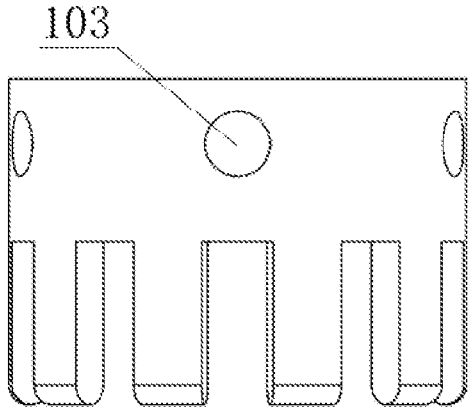
Figure 4D:
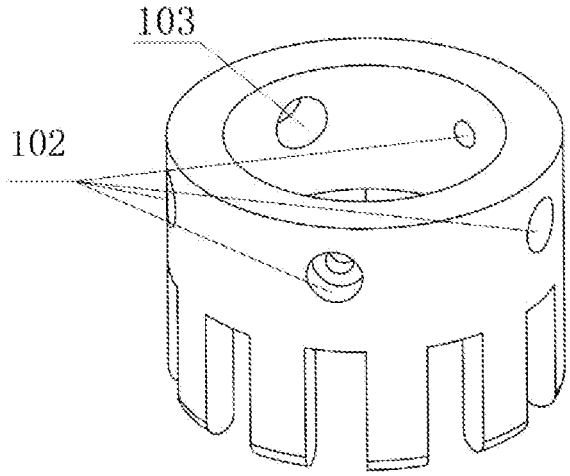
Figure 5A:
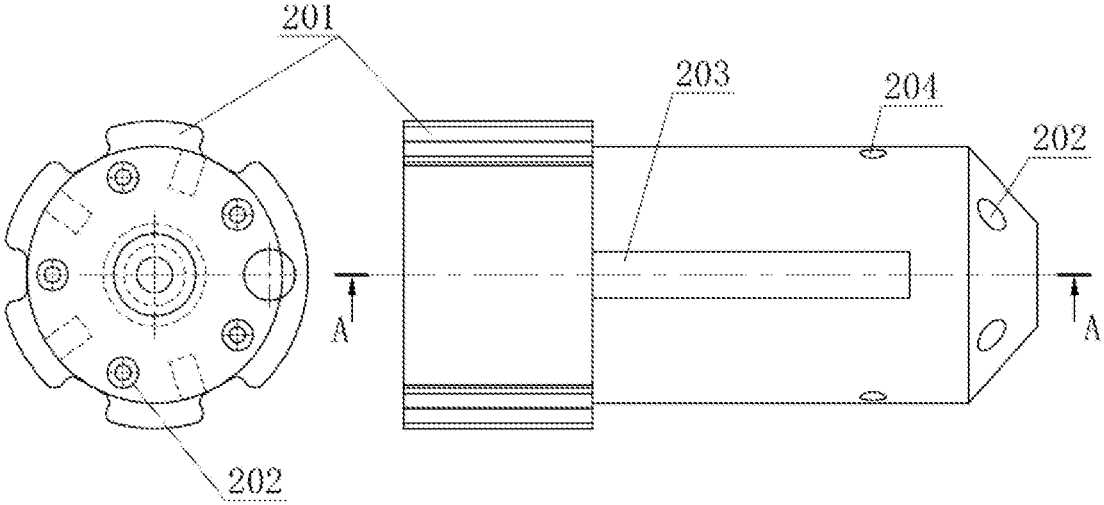
FIG. 5A to FIG. 5C illustrate schematic structural diagrams of an insulating rod.
Figure 5B:
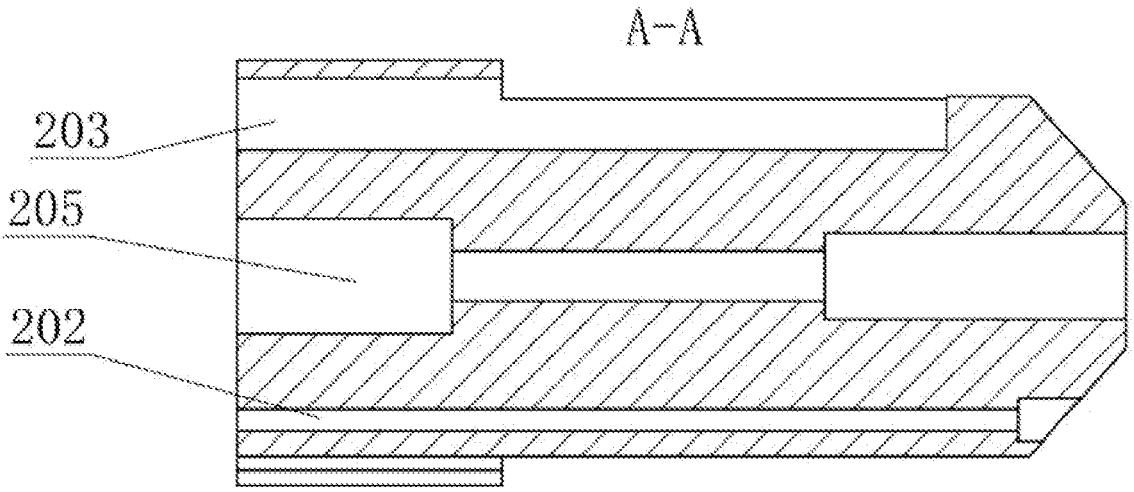
Figure 5C:
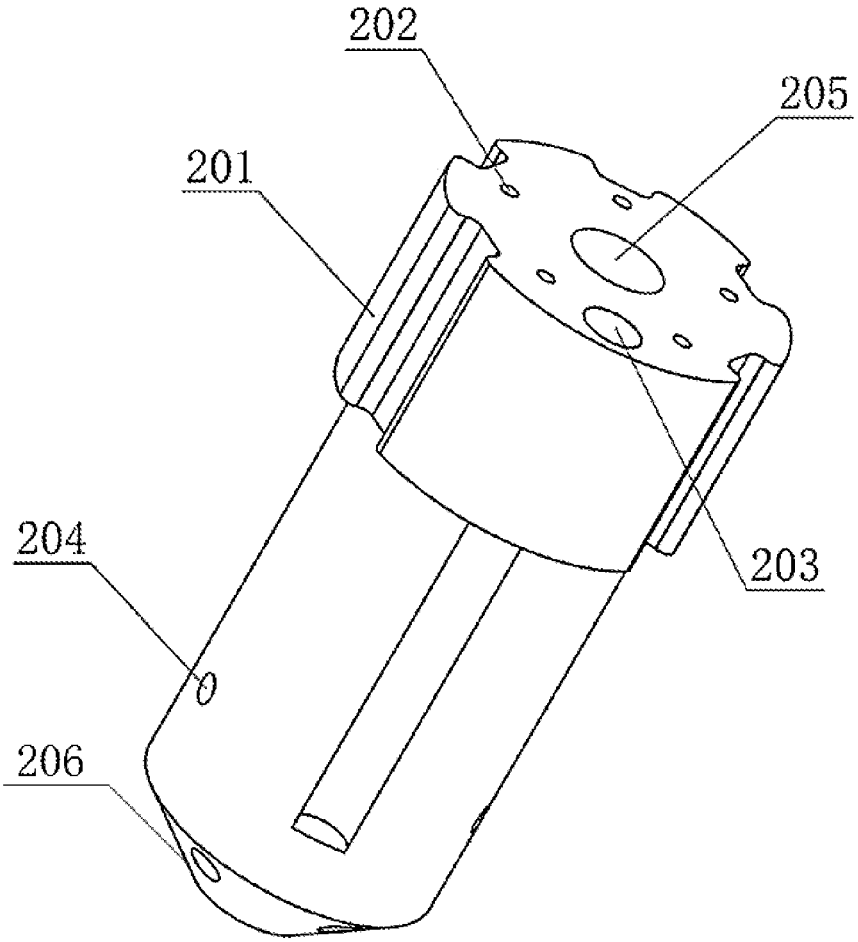
Figure 6A:
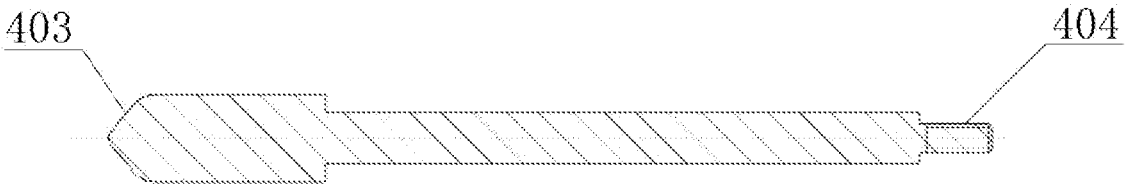
FIG. 6A and FIG. 6B illustrate schematic structural diagrams of a high-voltage electrode.
Figure 6B:
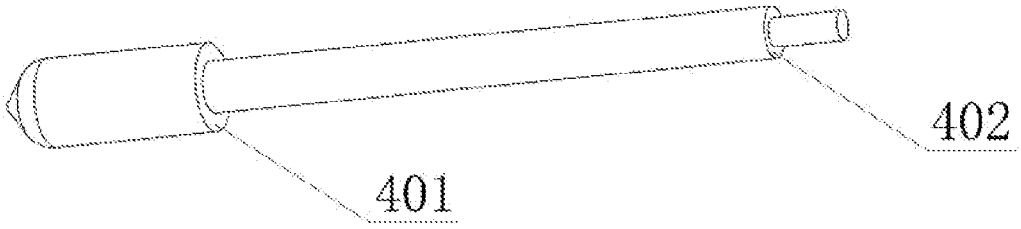
Figure 7A:
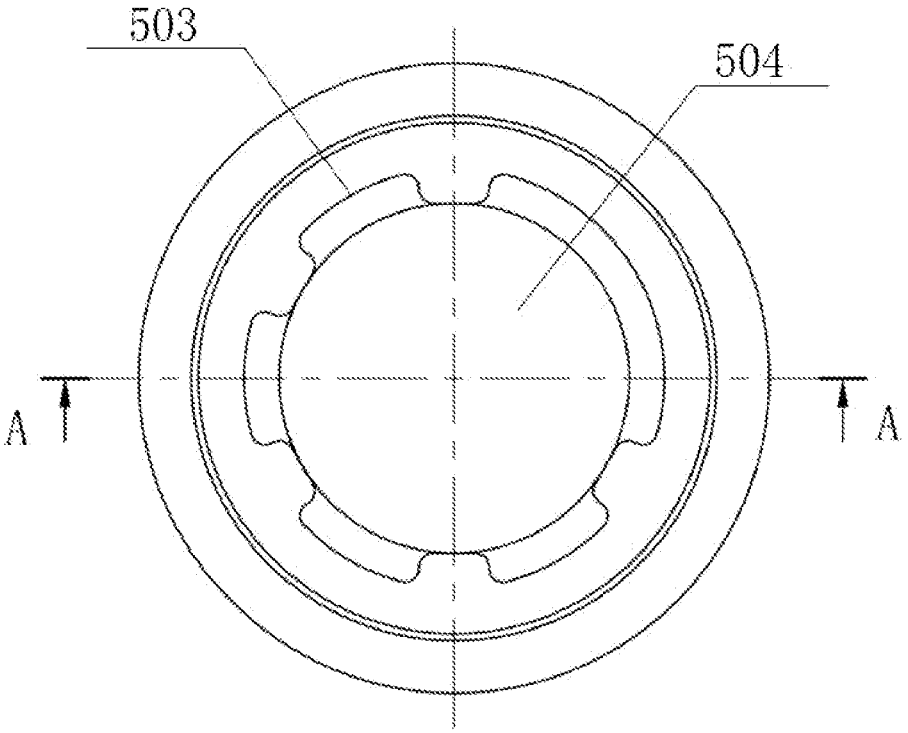
FIG. 7A to FIG. 7D illustrate schematic structural diagrams of an insulating spline sleeve.
Figure 7B:
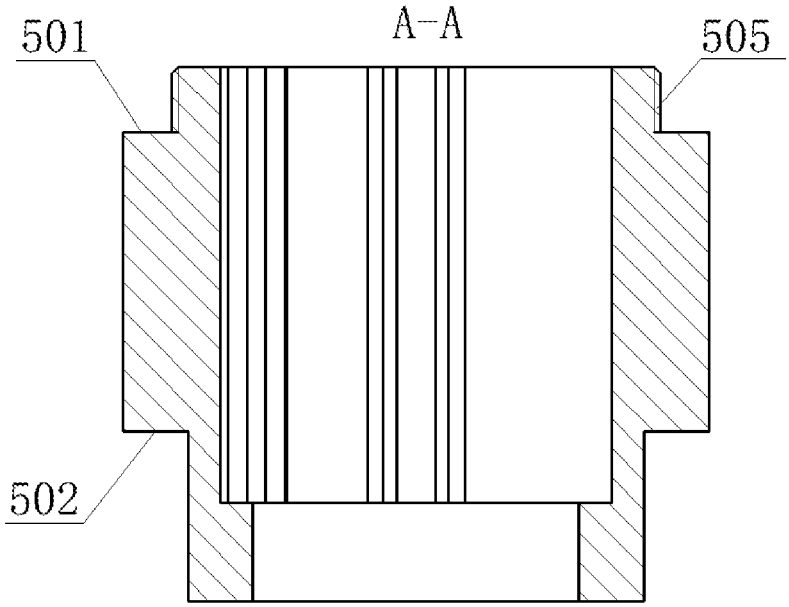
Figure 7C:
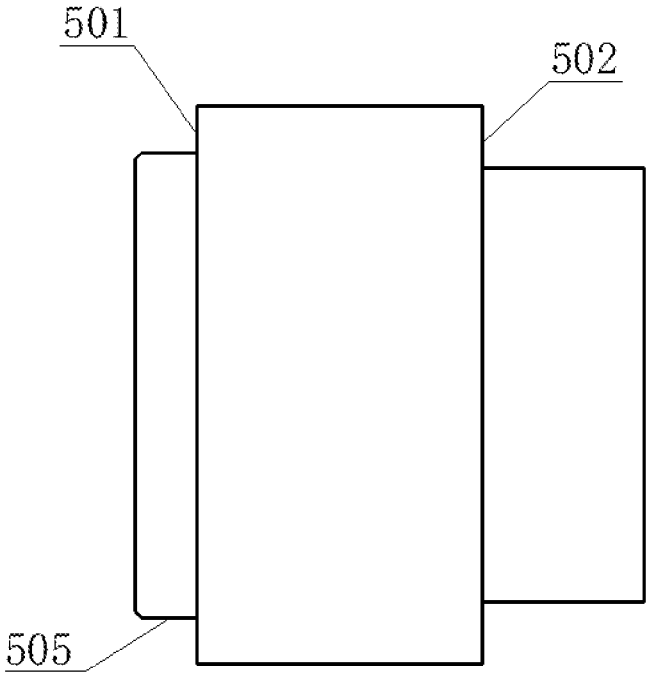
Figure 7D:
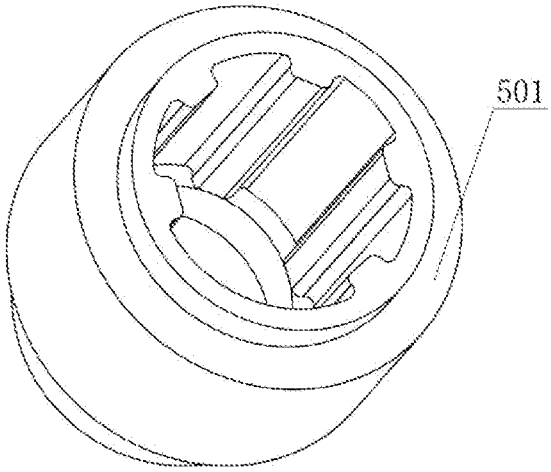
Figure 8A:
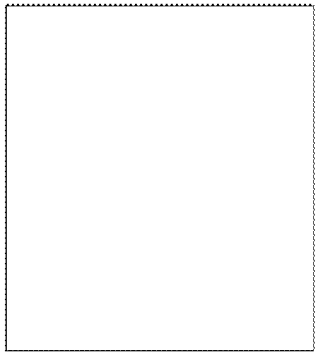
FIG. 8A and FIG. 8B illustrate schematic structural diagrams of a high-voltage cable connector.
Figure 8B:
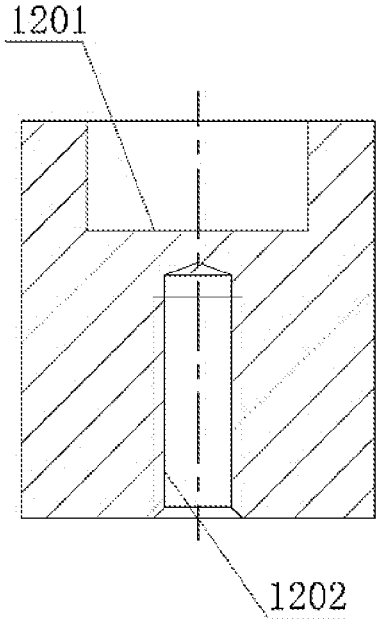
Figure 9:
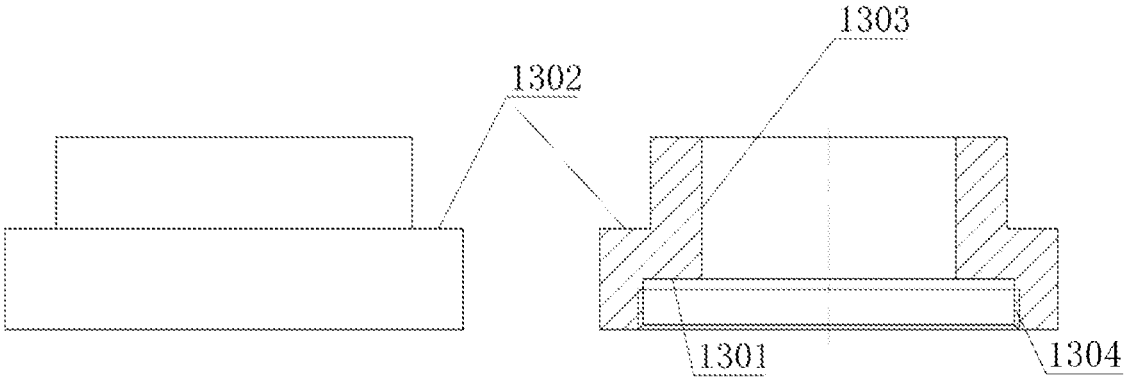
FIG. 9 illustrates a schematic structural diagram of an insulating limit cover.
Figure 10A:
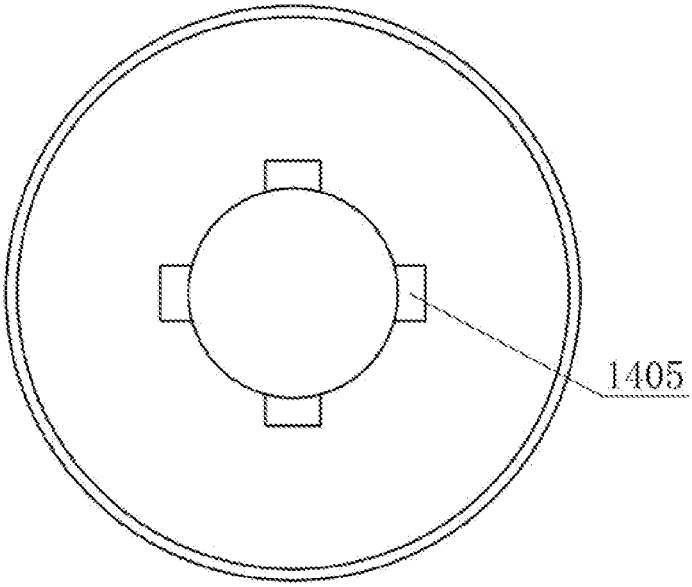
FIG. 10A to FIG. 10C illustrate schematic structural diagrams of an end cover.
Figure 10B:
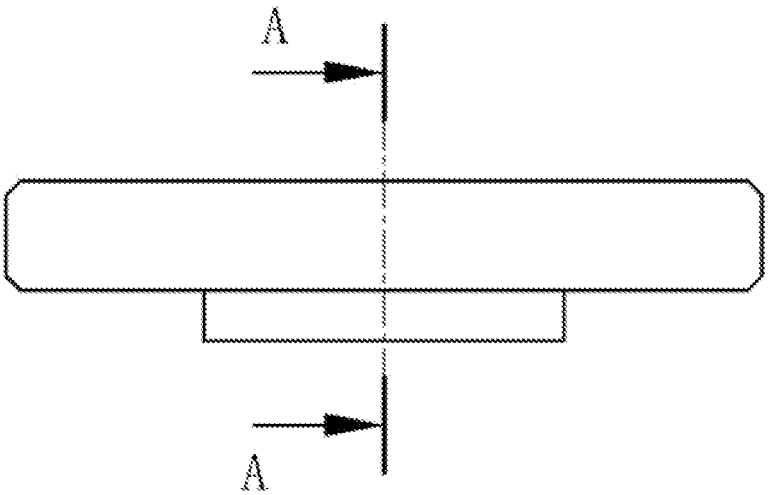
Figure 10C:
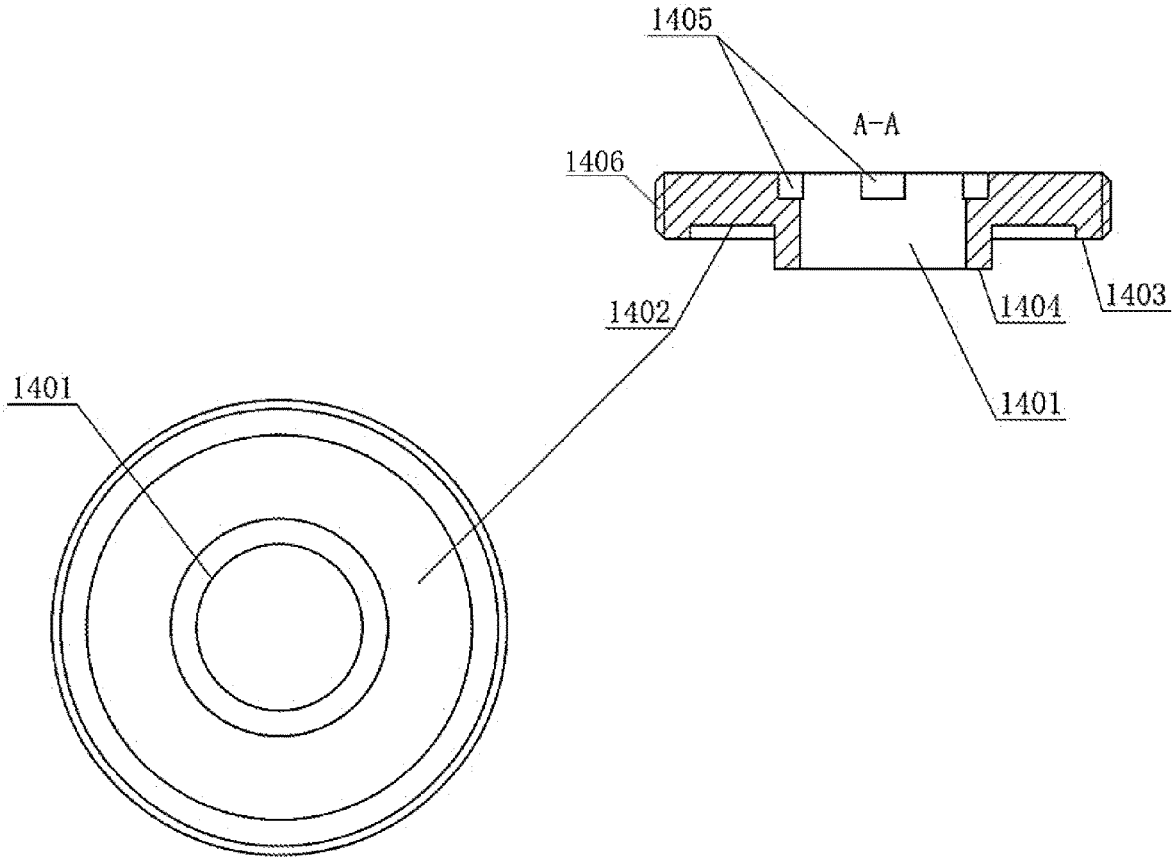

1: ground electrode; 2: insulating rod; 3: high-voltage electrode spring; 4: high-voltage electrode; 5: insulating spline sleeve; 6: upper bearing; 7: conical connecting component; 8: PDC bit; 9: electrode screw; 10: electrode drill bit spring; 11: lower bearing; 12: high-voltage cable connector; 13: insulating limit cover; 14: end cover; 101: petal-shaped structure; 102: screw hole; 103: welding hole; 201: spline; 202: drilling fluid flow channel; 203: cable hole; 204: electrode screw hole; 205: electrode-installed hole; 206: conical structure; 401: spring step; 402: connector step; 403: conical structure; 404: threaded structure; 501: outer step; 502: lower bearing step; 503: spline structure; 504: inner cavity; 505: screw threads; 701: inner cavity; 702: screw threads; 801: internal bearing step; 802: drilling fluid hole; 803: blade; 804: screw threads; 805: blade notch; 1201: cable groove; 1202: threaded hole; 1301: limit cover inner step; 1302: upper bearing step; 1303: limit cover through-hole; 1304: screw threads; 1401: flow channel; 1402: annular groove; 1403: bearing step; 1404: inner step; 1405: square groove; 1406: screw threads.

DETAILED DESCRIPTION OF EMBODIMENTS

The disclosure is further described below in connection with embodiments, and it should be noted that in this specification, terms such as "upper" and "lower" are used only for convenience in descriptions of accompanying drawings, are not intended to limit orientation in actual use, and do not necessarily require or imply any such actual relationship or order between these entities or operations. And terms such as "include" "have" or any other variations thereof are intended to cover non-exclusive inclusion, thereby a process, a method, an article, or an equipment including a set of elements includes not only the elements but also other elements not expressly listed, or inherent elements to the process, the method, the article or the equipment.

Some embodiments of the disclosure are described below, in conjunction with the accompanying drawings, as a combined drill bit based on the electro-pulse-drilling technology.

The disclosure provides the combined drill bit based on the electro-pulse-drilling technology as shown in the accompanying drawings. The combined drill bit based on the electro-pulse-drilling technology includes a ground electrode 1, an insulating rod 2, a high-voltage electrode spring 3, a high-voltage electrode 4, an insulating spline sleeve 5, an upper bearing 6, a conical connecting component 7, a PDC bit 8, electrode screws 9, an electrode drill bit spring 10, a lower bearing 11, a high-voltage cable connector 12, an insulating limit cover 13, and an end cover 14. The ground electrode 1 is a cylindrical structure, a lower end of the ground electrode 1 is provided with a centrally symmetrical petal-shaped structure 101, and a circumferential surface of an upper part of the ground electrode 1 defines screw holes 102 and a welding hole 103 configured to weld an earth cable. An upper part of the insulating rod 2 is provided with a spline 201, an upper end surface of the insulating rod 2 defines drilling fluid flow channels 202 and a cable hole 203 configured to install the earth cable, a center axis of the insulating rod 2 defines an electrode-installed hole 205, a middle-lower part of the insulating rod 2 defines electrode screw holes 204, and a lower part of the insulating rod 2 is provided with a conical structure 206. The high-voltage electrode 4 is a rod-shaped structure, a lower end of the high-voltage electrode 4 is provided with a conical structure 403, and a middle-lower part of the high-voltage electrode 4 is provided with a spring step 401 installed with the high-voltage electrode spring 3, and an upper part of the high-voltage electrode 4 is provided with a connector step 402 and a threaded structure 404 which are connected the high-voltage cable connector 12. The insulating spline sleeve 5 is a hollow structure, an upper part of the insulating spline sleeve 5 is provided with an outer step 501 and screw threads 505 which are matched with the insulating limit cover 13, an inner part of the insulating spline sleeve 5 is provided with a spline structure 503 matched with the insulating rod 2, and a lower part of the insulating spline sleeve 5 is provided with a lower bearing step 502 matched with the lower bearing 11. The high-voltage cable connector 12 is a cylindrical structure, a center of an upper end surface of the high-voltage cable connector 12 defines a cable groove 1201 configured to weld high-voltage cables, and a center axis of a lower part of the high-voltage cable connector 12 defines a threaded hole 1202 matched with the high-voltage electrode 4. A center of the insulating limit cover 13 defines a limit cover through-hole 1303, an inner part of the insulating limit cover 13 is provided with a limit cover inner step 1301 and screw threads 1304 which are matched with the insulating spline sleeve 5, and an outer circumferential surface of the insulating limit cover 13 is provided with an upper bearing step 1302 matched with the upper bearing 6. A center axis of the end cover 14 defines a flow channel 1401, an outer circumferential surface of the end cover 14 is provided with screw threads 1406 matched with the PDC bit 8, and a lower part of the end cover 14 defines an annular groove 1402 installed with the insulating limit cover 13, the lower part of the end cover 14 is provided with a bearing step 1403 fixed with the upper bearing 6, and the lower part of the end cover 14 is further provided with an inner step 1404, and an upper surface of the end cover 14 defines square grooves 1405 for easy installation. The PDC bit 8 is a hollow structure, the PDC bit 8 is provided with an internal bearing step 801 installed with the lower bearing 11, an inner cylindrical surface of a top of the PDC bit 8 is provided with screw threads 804 matched with the end cover 14, and the PDC bit 8 defines drilling fluid holes 802. The conical connecting component 7 is a hollow structure and is fixedly connected with the PDC bit 8 by welding, and an outer surface of the conical connecting component 7 is provided with screw threads 702.

Furthermore, the high-voltage electrode spring 3 and the electrode drill bit spring 10 are both compression springs with low rigidity and high elasticity.

Furthermore, the upper bearing 6 and the lower bearing 11 are identical angular contact ball bearings and are installed face-to-face.

Furthermore, the ground electrode 1 is in a clearance fit with the PDC bit 8, the high-voltage electrode 4 is in a clearance fit with the insulating rod 2, the insulating spline sleeve 5 is in a clearance fit with the PDC bit 8, and the high-voltage cable connector 12 is in a clearance fit with the insulating rod 2.

Furthermore, the insulating spline sleeve 5 is in an interference fit with the lower bearing 11, the lower bearing 11 is in an interference fit with the PDC bit 8, the insulating limit cover 13 is in an interference fit with the upper bearing 6, and the upper bearing 6 is in an interference fit with the PDC bit 8.

Furthermore, the number of the drilling fluid holes 802 are same as the number of blades 803 of the PDC bit 8.

Furthermore, the number of the drilling fluid flow channels 202 of the insulating rod 2 is 4 to 6, and the number of the electrode screw holes 204 of the insulating rod 2 is 3 to 5.

Furthermore, a drilling fluid path I of the combined drill bit is defined by an inner cavity 701 of the conical connecting component 7, the flow channel 1401 of the end cover 14, the limit cover through-hole 1303 of the insulating limit cover 13, an inner cavity 504 of the insulating spline sleeve 5, and the drilling fluid flow channels 202 of the insulating rod 2; a drilling fluid path II of the combined drill bit is defined by the inner cavity 701 of the conical connecting component 7 and the drilling fluid holes 802 of the PDC bit 8; and a drilling fluid circulation path is defined by the drilling fluid path I, the drilling fluid path II and blade notches 805.

Furthermore, the insulating rod 2, the insulating spline sleeve 5 and the insulating limit cover 13 are all made of insulating materials.

Furthermore, the high-voltage electrode spring 3 is fixedly connected with the high-voltage electrode 4 by welding, and the electrode drill bit spring 10 is fixedly connected with the ground electrode 1 by welding.

Drilling process of the disclosure is as follows.

The combined drill bit provided by the disclosure is used in conjunction with a drilling string with cables. The high-voltage cables in the cables are welded to the cable groove 1201 of the high-voltage cable connector 12, and the earth cable passes through the cable hole 203 of the insulating rod 2 and is welded to the welding hole 103 of the ground electrode 1. Installation steps of the combined drill bit are as follows: The high-voltage electrode spring 3 is fixedly connected to the high-voltage electrode 4 by welding, and the electrode drill bit spring 10 is fixedly connected to the ground electrode 1 by welding. Then, the high-voltage electrode spring 3 and the high-voltage electrode 4 which are fixedly connected to each other are installed into the electrode-installed hole 205 of the insulating rod 2. Furthermore, the high-voltage electrode spring 3 is pressed to a limit state, and the high-voltage cable connector 12 is fixedly connected to the high-voltage electrode 4 by the threaded structure 404. Furthermore, the insulating rod 2 is installed into the insulating spline sleeve 5 by spline fitting. Furthermore, the electrode screws 9 are passed through the screw holes 102 of the ground electrode 1, and then through the electrode screw holes 204 of the insulating rod 2 to fixedly connect the ground electrode 1 to the insulating rod 2. Furthermore, the insulating limit cover 13 is fixedly connected to the insulating spline sleeve 5 through the screw threads 1304. Furthermore, the lower bearing 11 is installed to the internal bearing step 801 of the PDC bit 8, and then the high-voltage electrode spring 3, the high-voltage electrode 4, the electrode drill bit spring 10, the ground electrode 1, the high-voltage cable connector 12, the electrode screws 9, the insulating spline sleeve 5 and the insulating limit cover 13 are installed into the PDC bit 8, and the lower bearing step 502 of the insulating spline sleeve 5 is in contact with an upper surface of the lower bearing 11. Furthermore, the upper bearing 6 is installed. Furthermore, the end cover 14 is fixedly connected to the PDC bit 8 by the screw threads 1406. Finally, the conical connecting component 7 is fixedly connected to the PDC bit 8 by welding.

During the drilling process, the ground electrode 1, the high-voltage electrode 4 and the PDC bit 8 are in direct contact with rocks, and the PDC bit 8 rotates continuously under drive of the drilling string, while the ground electrode 1 and the high-voltage electrode 4 can realize relative rotation with the PDC bit 8 and remain relative stillness during the drilling process under combined action of the high-voltage electrode spring 3, the electrode drill bit spring 10, the insulating rod 2 and the insulating spline sleeve 5. At the same time, the high-voltage electrode spring 3 and the electrode drill bit spring 10 enable the high-voltage electrode 4 and the ground electrode 1 to adjust axial positions according to changes of rock surfaces at the bottom of a well. In addition, the high-voltage electrode spring 3 and the electrode drill bit spring 11 can absorb vibration and impact generated in process of electro-pulse rock-breaking. Rocks at the bottom of the well within an outer circumferential surface of the ground electrode 1 are removed by continuous pulse discharge between the high-voltage electrode 4 and the ground electrode 1, and rocks at the bottom of the well outside the outer circumferential surface of the ground electrode 1 are removed by continuous rotation of the PDC bit 8. Rock cuttings generated by the combined drill bit is carried away to ground by drilling fluid.

Above mentioned is only an embodiment of the disclosure, and is not a limitation of the disclosure. Although the disclosure is described by the embodiment, it is not intended to limit the disclosure, and those skilled in the art may make some changes or modifications to above technical solutions as an equivalent embodiment without departing from scope of the technical solutions of the disclosure. Any simple amendments, equivalent changes and modifications made to the embodiment based on technical substance of the disclosure, without departing from content of the technical solutions of the disclosure, still fall within the scope of the technical solutions of the disclosure.

What is claimed is:

1. A combined drill bit, comprising:

a ground electrode, an insulating rod, an electrode spring, a connecting electrode, an insulating spline sleeve, an upper bearing, a conical connecting component, a polycrystalline diamond compact (PDC) bit, electrode screws, an electrode drill bit spring, a lower bearing, a cable connector, an insulating limit cover, and an end cover;

wherein the ground electrode is a cylindrical structure, a lower end of the ground electrode is provided with a centrally symmetrical petal-shaped structure, and a circumferential surface of an upper part of the ground electrode defines screw holes and a welding hole configured to weld an earth cable;

wherein an upper part of the insulating rod is provided with a spline, an upper end surface of the insulating rod defines drilling fluid flow channels and a cable hole configured to install the earth cable, a center axis of the insulating rod defines an electrode-installed hole, a middle-lower part of the insulating rod defines electrode screw holes, and a lower part of the insulating rod is provided with a conical structure;

wherein the connecting electrode is a rod-shaped structure, a lower end of the connecting electrode is provided with a conical structure, a middle-lower part of the connecting electrode is provided with a spring step installed with the electrode spring, and an upper part of the connecting electrode is provided with a connector step and a threaded structure which are connected to the cable connector;

wherein the insulating spline sleeve is a hollow structure, an upper part of the insulating spline sleeve is provided with an outer step and screw threads which are matched with the insulating limit cover, an inner part of the insulating spline sleeve is provided with a spline structure matched with the insulating rod, and a lower part of the insulating spline sleeve is provided with a lower bearing step matched with the lower bearing;

wherein the cable connector is a cylindrical structure, a center of an upper end surface of the cable connector defines a cable groove configured to weld cables, and a center axis of a lower part of the cable connector defines a threaded hole matched with the connecting electrode;

wherein a center of the insulating limit cover defines a limit cover through-hole, an inner part of the insulating limit cover is provided with a limit cover inner step and screw threads which are matched with the insulating spline sleeve, and an outer circumferential surface of the insulating limit cover is provided with an upper bearing step matched with the upper bearing;

wherein a center axis of the end cover defines a flow channel, an outer circumferential surface of the end cover is provided with screw threads matched with the PDC bit, and a lower part of the end cover defines an annular groove installed with the insulating limit cover, the lower part of the end cover is provided with a bearing step fixed with the upper bearing, and the lower part of the end cover is further provided with an inner step, and an upper surface of the end cover defines square grooves;

wherein the PDC bit is a hollow structure, the PDC bit is provided with an internal bearing step installed with the lower bearing, an inner cylindrical surface of a top of the PDC bit is provided with screw threads matched with the end cover, and the PDC bit defines drilling fluid holes; and wherein the conical connecting component is a hollow structure and is fixedly connected with the PDC bit by welding.

2. The combined drill bit as claimed in claim 1, wherein the electrode spring and the electrode drill bit spring are both compression springs.

3. The combined drill as claimed in claim 1, wherein the upper bearing and the lower bearing are identical angular contact ball bearings and are installed face-to-face.

4. The combined drill bit as claimed in claim 1, wherein the ground electrode is in a clearance fit with the PDC bit, the connecting electrode is in a clearance fit with the insulating rod, the insulating spline sleeve is in a clearance fit with the PDC bit, and the cable connector is in a clearance fit with the insulating rod.

5. The combined drill as claimed in claim 1, wherein the insulating spline sleeve is in an interference fit with the lower bearing, the lower bearing is in an interference fit with the PDC bit, the insulating limit cover is in an interference fit with the upper bearing, and the upper bearing is in an interference fit with the PDC bit.

6. The combined drill bit as claimed in claim 1, wherein the number of the drilling fluid holes are same as the number of blades of the PDC bit.

7. The combined drill bit as claimed in claim 1, wherein the number of the drilling fluid flow channels of the insulating rod is 4 to 6, and the number of the electrode screw holes of the insulating rod is 3 to 5.

8. The combined drill bit as claimed in claim 1, wherein a drilling fluid path I of the combined drill bit is defined by an inner cavity of the conical connecting component, the flow channel of the end cover, the limit cover through-hole of the insulating limit cover, an inner cavity of the insulating spline sleeve, and the drilling fluid flow channels of the insulating rod; a drilling fluid path II of the combined drill bit is defined by the inner cavity of the conical connecting component and the drilling fluid holes of the PDC bit; and a drilling fluid circulation path is defined by the drilling fluid path I, the drilling fluid path II and blade notches.

9. The combined drill as claimed in claim 1, wherein the insulating rod, the insulating spline sleeve and the insulating limit cover are all made of insulating materials.

10. The combined drill as claimed in claim 1, wherein the electrode spring is fixedly connected with the connecting electrode by welding, and the electrode drill bit spring is fixedly connected with the ground electrode by welding.

* * * * *